US006468723B2

(12) United States Patent
Tappe et al.

(10) Patent No.: US 6,468,723 B2
(45) Date of Patent: Oct. 22, 2002

(54) CONCENTRATE COMPRISING A P-PHENYLENEDIAMINE DERIVATIVE

(75) Inventors: Gustav Tappe, Leverkusen (DE); Wolfgang Körner, Leverkusen (DE); Gerhard Schmid, Oberriexingen (DE)

(73) Assignee: Agfa-Gevaert N.V. (BE)

( * ) Notice: Subject to any disclaimer, the term of this patent is extended or adjusted under 35 U.S.C. 154(b) by 0 days.

(21) Appl. No.: 09/854,499

(22) Filed: May 14, 2001

(65) Prior Publication Data

US 2001/0055734 A1 Dec. 27, 2001

(30) Foreign Application Priority Data

May 17, 2000 (DE) ..... 100 24 263

(51) Int. Cl.[7] ..... G03C 7/413
(52) U.S. Cl. ..... 430/466
(58) Field of Search ..... 430/466

(56) References Cited

U.S. PATENT DOCUMENTS 3,816,134 A 6/1974 Schellenberg et al. ..... 430/376
4,298,681 A 11/1981 Bulloch et al. ..... 430/466
6,017,687 A * 1/2000 Darmon et al. ..... 430/466
6,077,651 A * 6/2000 Darmon et al. ..... 430/434

FOREIGN PATENT DOCUMENTS

| | | |
|---|---|---|
| JP | 10333302 | 12/1998 |
| JP | 11194462 | 7/1999 |
| JP | 980 024 | 2/2000 |

* cited by examiner

*Primary Examiner*—Hoa Van Le
(74) *Attorney, Agent, or Firm*—Connolly Bove Lodge & Hutz LLP

(57) ABSTRACT

A concentrated aqueous solution of a p-phenylenediamine derivative, which a) has a pH higher than 12.5, b) contains 0.4 to 1.1 mol p-phenylenediamine derivative/litre, c) contains 0.05 to 2 mol of an antioxidant/litre, d) contains at most 35% by weight of organic solvents with respect to the total solution, e) contains at most 50 mmol sulphate ions/litre and f) is single-phase, is suitable for the production of different colour developer formulations.

11 Claims, No Drawings

CONCENTRATE COMPRISING A P-PHENYLENEDIAMINE DERIVATIVE

This invention relates to a concentrated solution of p-phenylenediamine derivatives, e.g. of N-(2-methylsulphonylaminoethyl)-N-ethyl-3-methyl-p-phenylenediamine (CD-3) and of N-(2-hydroxyethyl)-N-ethyl-3-methyl-p-phenylenediamine (CD-4).

p-phenylenediamine derivatives, particularly the aforementioned compounds CD-3 and CD-4, are known developer substances for colour photographic silver halide materials. They are normally used as a concentrated solution in sulphuric acid. This acidic solution is very stable due to a small addition of sulphite. The free bases of p-phenylenediamine derivatives are very susceptible to oxidation, however, both in solution and in solid form.

If a sulphuric acid concentrate of p-phenylenediamine derivatives is neutralised with alkali hydroxides, precipitates are formed in the concentrate.

For use in one-part colour developer concentrates, however, neutralisation is absolutely necessary, since colour development only occurs under alkaline conditions. Therefore, the colour developer concentrate already has to be alkaline. In order to produce different colour developer formulations, there is therefore a need for a stable, alkaline p-phenylenediamine derivative which can be used universally.

The present invention thus relates to a concentrated, aqueous solution of a p-phenylenediamine derivative, characterised in that it a) has a pH higher than 12.5, b) contains 0.4 to 1.1 mol p-phenylenediamine derivative/litre, c) contains 0.05 to 2 mol of an antioxidant/litre, d) contains at most 35 % by weight of organic solvents with respect to the total solution, e) contains at most 50 mmol sulphate ions/litre and f) is single-phase.

The pH is preferably higher than 13.

This concentrated solution can be produced from the free base or from salts of the respective p-phenylenediamine derivative.

Examples of salts of the p-phenylenediamine derivative which can be used include phosphates, chlorides and sulphates. When sulphates are used, the sulphate is separated off, e.g. as an alkali sulphate (as described in EP 0 980 024, paragraph 58).

EP 0 980 024 describes a concentrated alkaline CD-3 solution which contains an antioxidant and which is low in sulphate. This concentrated solution consists of two phases. Phase separation is only suppressed if large amounts of ethylene glycol are added. A two-phase concentrate is unsuitable for the produktion of a colour developer concentrate.

Suitable water-soluble organic solvents include those from the series comprising glycols, polyglycols, alkanolamines, aliphatic and heterocyclic carbonamides, and aliphatic and cyclic monoalcohols.

Examples of suitable water-soluble solvents include derivatives of carboxylic acid amides and derivatives of urea such as dimethylformamide, methylacetamide, dimethylacetamide, N,N'-dimethylurea, tetramethylurea, methanesulphonic acid amide, dimethylethylene-urea, N-acetylglycine, N-valeramide, isovaleramide, N-butyramide, N,N-dimethylbutyramide, N-(2-hydroxyphenyl)-acetamide, N-(2-meth-oxyphenyl)-acetamide, 2-pyrrolidinone, ϵ-caprolactam, acetanilide, benzamide toluenesulphonic acid amide, phthalimide;

aliphatic and cyclic alcohols e.g. isopropanol, tert.-butyl alcohol, cyclohexanol, cyclohexane-methanol, 1,4-cyclohexanedimethanol;

aliphatic and cyclic polyalcohols, e.g. glycols, polyglycols, polymer waxes, tri-methyl-1,6-hexanediol, glycerol, 1,1,1-trimethylolpropane, pentaerythritol, sorbitol;

aliphatic and cyclic ketones, e.g. acetone, ethyl methyl ketone, ethyl ketone, tert.-butyl methyl ketone, diisobutyl ketone, acetylacetone, acetonylacetone, cyclo-pentanone, acetophenone;

esters of aliphatic and cyclic carboxylic acids, e.g. triethoxymethane, methyl acetate, allyl acetate, methyl glycol acetate, ethylene glycol diacetate, glycerol-l-acetate, glycerol diacetate, methylcyclohexyl acetate, methyl salicylate, phenyl salicylate;

aliphatic and cyclic esters of phosphonic acid, e.g. methylphosphonic acid dimethyl ester, allylphosphonic acid diethyl ester;

aliphatic and cyclic oxyalcohols, e.g. 4-hydroxy-4-methyl-2-pentanone, salicyl-aldehyde;

aliphatic and cyclic aldehydes, e.g. acetaldehyde, propanal, trimethylacetaldehyde, crotonaldehyde, glutaraldehyde, 1,2.5,6-tetrahydrobenzaldehyde, benzaldehyde, benzene-propane, terephthalaldehyde;

aliphatic and cyclic oximes, e.g. butanone oxime, cyclohexanone oxime;

aliphatic and cyclic amines (primary, secondary or tertiary), e.g. ethylamine, diethyl-amine, triethylamine, dipropylamine, pyrrolidine, morpholine, 2-amino-pyrimidine;

aliphatic and cyclic polyamines (primary, secondary or tertiary), e.g. ethylene-diamine, 1-amino-2-diethylaminoethane, methyl-bis-(2-methylamino-ethyl) amine, permethyldiethylenetriamine, 1,4-cyclohexanediamine, 1,4-benzene-diamine;

aliphatic and cyclic hydroxyamines, e.g. ethanolamine, 2-methylethylamine, 2-methylaminoethanol, 2-(dimethylamino)ethanol, 2-(2-dim ethylamino-ethoxy)-ethanol, diethanolamine, N-methyldiethanolamine, triethanolamine, 2-(2-aminoethyl- amino)-ethanol, triisopropanolamine, 2-amino-2-hydroxymethyl-1,3-propanediol, 1-piperidine-ethanol, 2-aminophenol, barbituric acid, 2-(4-aminophenoxy)-ethanol, 5-amino-l-naphthol.

Suitable antioxidants are compounds of formulae (I), (II) and (III).

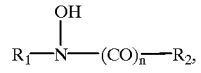

(I)

wherein $R_1$ denotes an alkyl which is optionally substituted, $R_2$ denotes an alkyl which is optionally substituted or an aryl which is optionally substituted, and n denotes 0 or 1, preferably those in which at least one of the $R_1$ and $R_2$ radicals contains at least one —OH, —COOH or —$SO_3H$ group;

(II)

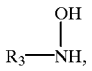

wherein $R_3$ denotes an alkyl or acyl group;

(III)

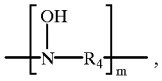

wherein $R_4$ denotes an alkylene group which is optionally interrupted by 0 atoms, and m denotes a number of at least 2.

In addition to the aforementioned types of substitution, the alkyl groups $R_1$, $R_2$, $R_3$, the alkylene group $R_4$ and the aryl group $R_2$ can also contain other substituents.

Examples of suitable antioxidants include (0-1)

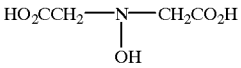

(0-2)

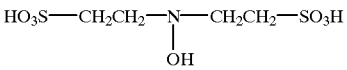

(HADS)

(0-3)

$CH_3CH(CH_3)NHOH$ (0-4)

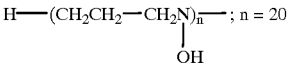

; n = 20

(0-5)

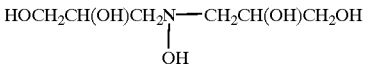

(0-6)

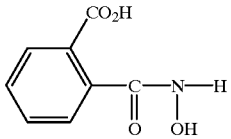

(0-7)

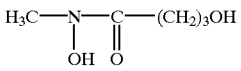

(0-8)

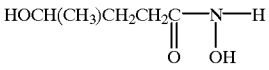

(0-9)

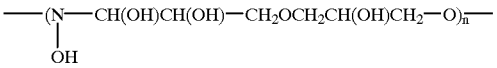

n = 10

(0-10)

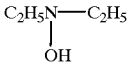

The preferred solvents are alcohols, glycols, polyglycols and caprolactam, and optionally mixtures thereof also. Preferred p-phenylenediamine derivatives are listed in EP 0 980 024, paragraph 28.

EXAMPLES

Example 1 (comparison)

| | |
|---|---|
| deionised water | 500 ml |
| aqueous potassium hydroxide solution, 45% by weight | 100 ml |
| diethylhydroxylamine, 85% by weight | 200 ml |
| CD 3 base | 190 g |
| made up to 1000 ml with deionised water | |
| pH 11.5 | |
| CD 3 was precipitated from this single-phase solution after a short period of time. | |

Example 2 (comparison)

| | |
|---|---|
| deionised water | 700 ml |
| aqueous potassium hydroxide solution 45% by weight | 150 ml |
| HADS | 150 g |
| CD 3 base | 190 g |
| made up to 1000 ml with deionised water | |
| pH 11.5 | |
| CD 3 was precipitated from this single-phase solution after a short period of time. | |

Example 3 (invention)

| | |
|---|---|
| deionised water | 300 ml |
| aqueous potassium hydroxide solution, 45% by weight | 300 ml |
| diethylhydroxylamine, 85% by weight | 200 ml |
| CD 3 base | 190 g |
| made up to 1000 ml with deionised water | |
| pH 14 | |
| No precipitate was formed from this single-phase solution, even after a long period of time. | |

Example 4 (invention)

| | |
|---|---|
| deionised water | 400 ml |
| aqueous potassium hydroxide solution, 45% by weight | 350 ml |
| HADS | 150 g |
| CD 3 base | 190 g |
| made up to 1000 ml with deionised water | |
| pH 14 | |
| No precipitate was formed from this single-phase solution, even after a long period of time. | |

Example 5 (invention)

| | |
|---|---|
| deionised water | 200 ml |
| aqueous potassium hydroxide solution, 45% by weight | 360 ml |
| diethylhydroxylamine, 85% by weight | 200 ml |
| CD 3 phosphate | 220 g |
| made up to 1000 ml with deionised water | |
| pH 14 | |
| No precipitate was formed from this single-phase solution, even after a long period of time. | |

Example 6 (invention)

| | |
|---|---|
| deionised water | 200 ml |
| aqueous potassium hydroxide solution, 45% by weight | 400 ml |
| diethylhydroxylamine, 85% by weight | 200 ml |
| CD 3 sulphate | 300 g |
| diethylene glycol | 100 ml |
| made up to 1000 ml with deionised water | |
| pH 14 | |

Potassium sulphate, the solubility of which was low, was even precipitated during the dissolution of CD 3. In order to complete this precipitation, the batch was allowed to stand for one day whilst being cooled to minus 10C. The precipitated potassium sulphate was separated from the supernatant solution. The filtrate was a single-phase solution which was low in sulphate and from which nothing was precipitated even after a long period of time.

At a sufficiently high pH (Examples 3 to 6), the single-phase, low-sulphate concentrates remained stable.

What is claimed is:

1. A concentrated aqueous solution of a p-phenylenediamine derivative, which comprises a) has a pH higher that 12.5, b) contains 0.4 to 1.1 mol p-phenylenediamine derivative/litre, c) contains 0.5 to 2 mol of an antioxidant/litre, d) contains at most 35% by weight of organic solvents with respect to the total solution, e) contains at most 50 mmol sulphate ions/litre and f) is single-phase.

2. The concentrated aqueous solution according to claim 1, wherein said antioxidant corresponds to one of formulae (I), (II) and (III)

(I)

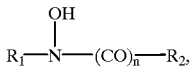

wherein $R_1$ denotes an alkyl which is optionally substituted, $R_2$ denotes an alkyl which is optionally substituted or an aryl which is optionally substituted, and n denotes 0 or 1;

(II)

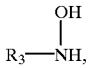

wherein $R_3$ denotes an alkyl or acyl group;

(III)

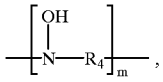

wherein $R_4$ denotes an alkylene group which is optionally interrupted by O atoms, and m denotes a number of at least 2.

3. The concentrated aqueous solution according to claim 1, wherein the p-phenylenediamine derivative is N-(2-methylsulphonylamino ethyl)-N-ethyl-3-methyl-p-phenylenediamine or N-(2-hydroxyethyl)-N-ethyl-3-methyl-p-phenylenediamine.

4. The concentrated aqueous solution according to claim 1, wherein the antioxidant is diethylhydroxylamine or di-(2-sulphoethyl)-hydroxylamine.

5. The concentrated aqueous solution according to claim 1, which further contains up to 0.5 mol sulphite/litre or up to 0.5 mol hydroxylamine/litre as an additional antioxidant.

6. The concentrated aqueous solution according to claim 1, wherein said organic solvents are water-soluble organic solvents.

7. A process for the production of one-part color developer concentrates which comprises neutralizing the concentrated aqueous solution according to claim 1.

8. A one-part color developer concentrate which comprises the concentrated aqueous solution according to claim 1.

9. The concentrated aqueous solution according to claim 1, wherein formula (I) is present and at least one of the radicals $R_1$ and $R_2$ contain —OH, —COOH or —$SO_3H$ group.

10. The concentrated aqueous solution according to claim 1, wherein said antioxidant is selected from the formula consisting of (0-1)

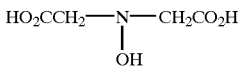

(0-2)

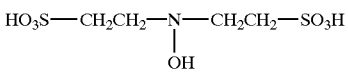

(HADS)

(0-3)

$CH_3CH(CH_3)NHOH$ (0-4)

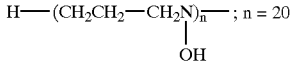

(0-5)

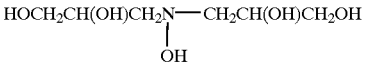

(0-6)

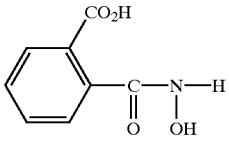

(0-7)

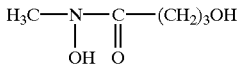

(0-8)

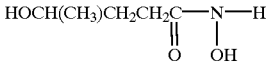

(0-9)

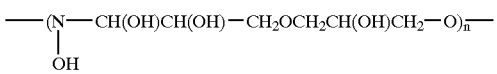

n = 10, and (0-10)

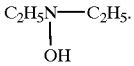

11. The concentrated aqueous solution according to claim 1, wherein said organic solvent is alcohol, glycol, polyglycol or caprolactam or mixtures thereof.

* * * * *